United States Patent [19]

Dolan

[11] Patent Number: 4,793,769

[45] Date of Patent: Dec. 27, 1988

[54] HOCKEY PUCK

[76] Inventor: Michael Dolan, 203 - 14th Ave., NE., Minneapolis, Minn. 55413

[21] Appl. No.: 163,602

[22] Filed: Mar. 3, 1988

[51] Int. Cl.[4] ..... A63B 71/00

[52] U.S. Cl. ..... 273/128 R

[58] Field of Search ..... 273/128 R, 126 R; 384/49

[56] References Cited

U.S. PATENT DOCUMENTS

| | | | |
|---|---|---|---|
| 2,444,810 | 7/1948 | Creasy | 273/128 R |
| 2,727,744 | 12/1955 | Watson | 273/128 R |
| 2,812,222 | 11/1957 | Gussack | 384/49 |
| 3,206,210 | 9/1965 | Bard | 273/128 R |
| 3,530,967 | 9/1970 | Huber et al. | 273/128 R |
| 3,784,204 | 1/1974 | Felber | 273/128 R |

FOREIGN PATENT DOCUMENTS

| | | | |
|---|---|---|---|
| 446956 | 3/1948 | Canada | 273/128 R |
| 2838189 | 3/1980 | Fed. Rep. of Germany | 273/128 R |

*Primary Examiner*—Robert E. Garrett
*Assistant Examiner*—Joseph M. Pitko
*Attorney, Agent, or Firm*—Paul L. Sjoquist

[57] ABSTRACT

The present invention is a hockey puck having a set of three freely-revolvable ball bearings recessed therein; the ball bearings permit the puck to move with little resistance on a surface and otherwise function like a regulation ice hockey puck.

7 Claims, 1 Drawing Sheet

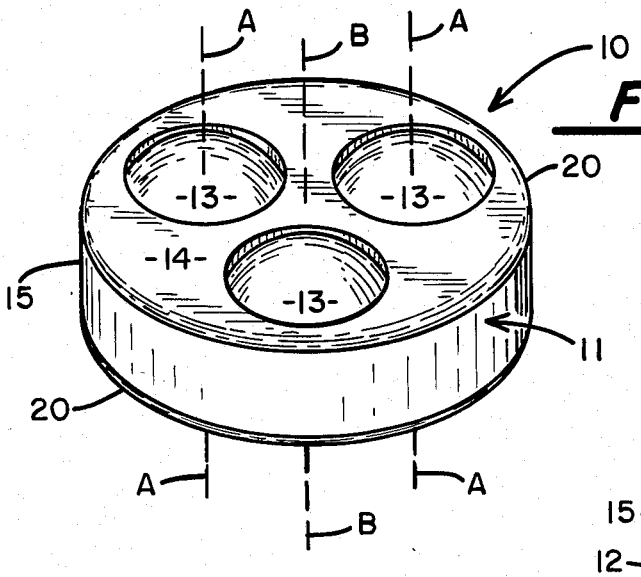
Fig. 1
Fig. 2
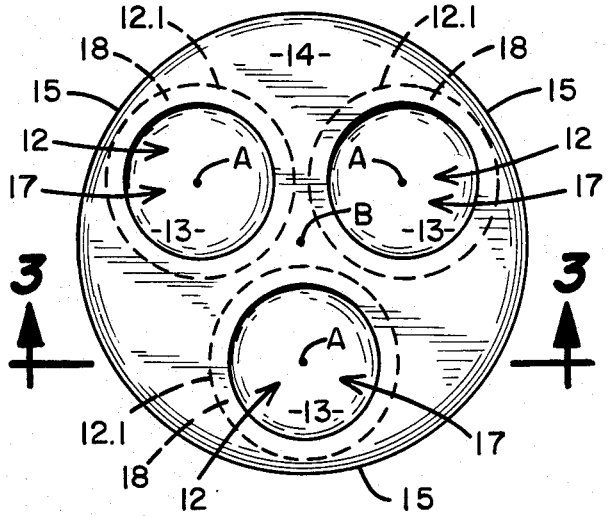
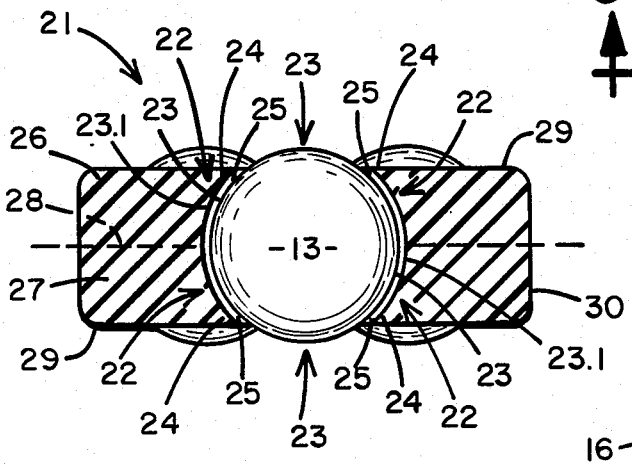
Fig. 5
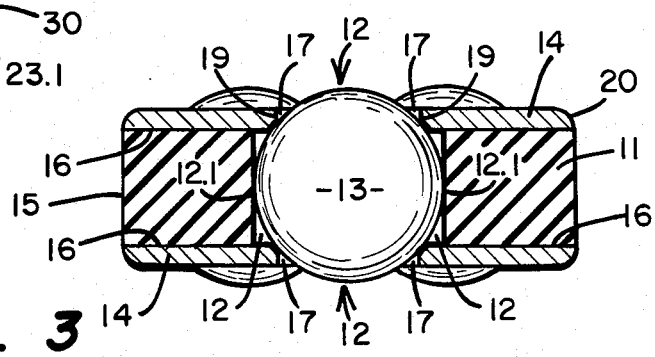
Fig. 3
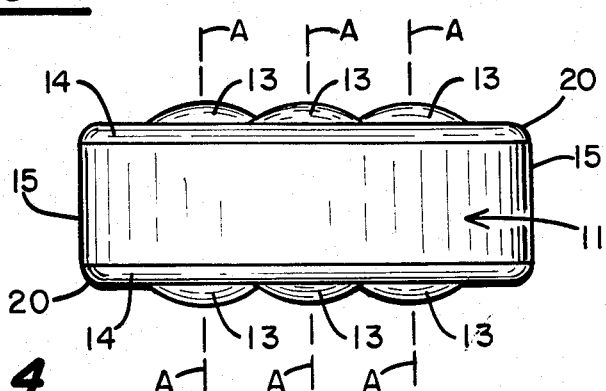
Fig. 4

HOCKEY PUCK

BACKGROUND OF THE INVENTION

1. Field of the Invention

The present invention relates to games of skill and sport, and finds particular utility in the game of hockey, which is played indoors or outdoors on a flat surface of ice or other material.

2. Background of the Invention

Ice hockey is played with a high density rubberized puck. The mass of the puck and its smooth faces are features that allow it to glide with little resistance on ice. While the smooth texture of the faces creates little friction with the ice, the mass of the puck and its high inertia permit it to stay in motion in a straight line and resist external forces acting upon it. Since the puck is shaped as a disk, it tends to glide over the surface on either of its flat sides. By skillfully playing it with a stick, i.e., hockey stick, it can be made to fly through the air along straight or curved paths.

Street hockey is a form of hockey played outside on an asphalt or concrete surface such as a street. Floor hockey my be played inside on the floor of a gymnasium. since a heavy rubber ice hockey puck would tend to stick to, rather than glide across, a street or gym floor, pucks used for street or floor hockey are typically lighter or have a different texture or shape than the disk-like ice hockey puck. For example, light plastic hollow disks or balls such as tennis or rubber balls frequently serve as pucks when the game of hockey is played off the ice.

A problem with plastic disks is that they usually have a high degree of friction with asphalt or concrete surfaces and gym floors unless they are made of very lightweight materials. In contrast to an ice hockey puck, a plastic disk's distance of travel and speed is significantly less for a given amount of force applied by a hockey stick. Passes between teammates and shots on goal are shorter and slower than in ice hockey. Even though the initial speed of a plastic disk hit by a stick may be high, the plastic disk's speed decreases as resistance is created between it and the surface on which it is traveling. Hence the "fastest game on ice" is reduced to a game with a different "feel," in which the amount and type of resistance encountered by the plastic disk is a major factor in the outcome.

Another problem with plastic pucks is that they frequently have little mass. They are thus deflected easily by stones on an asphalt surface or small irregularities on a gym floor. Furthermore, when hit by a hockey stick, they may fly into the air and behave like flying saucers with unpredictable directional changes. Hockey, on ice a game of skill, is thereby turned into a game of chance.

Still another problem with street hockey pucks is that they interact poorly with hockey sticks. When an ice hockey player is stick-handling a puck, his eyesare on the field of play rather than the puck. He knows the position of the puck because he can feel the heavy mass through the stick. In contrast, light plastic disks are difficult to control. Since the feel of a plastic disk through a hockey stick is soft, a player's eyes are on the disk when they should be on the action forming on the field. Furthermore, the plastic texture of a plastic disk tends to slip on a hockey stick even if the blade is covered with rubberized tape. With a rubberized ice hockey puck, a controlled spin may be applied by the blade so that the puck may travel in an arc around the goalie and into the net.

Even heavy rubber balls interact poorly with hockey sticks. Although the location of a heavy ball may be easier to ascertain without eye contact than a plastic disk, a ball is difficult to control because it bounces readily over the relatively narrow blade of a hockey stick in stick-handling maneuvers.

Still another problem with plastic disks is that they have little or no resiliency. When a hockey stick blade contacts a rubberized ice hockey puck, especially on a slap shot, the puck is compressed. As the puck leaves the blade, it decompresses and thereby gains energy for its forward motion. Moreover, the resiliency of the ice hockey puck makes it durable. In contrast, plastic disks may become permanently dented and nonfunctional when hit hard by a hockey stick. At the other extreme, rubber balls are too compressible and may absorb too much energy from a hockey stick to be hit at high speeds.

SUMMARY OF THE INVENTION

An object of the present invention is to provide a street hockey puck that possesses the structural and functional characteristics of an ice hockey puck.

A feature of the present invention is a set of three ball bearings each freely rotatable in a set of three bores preferably formed in a high density rubberized puck. The bearings may be retained in the bores by pair of plates connected to the faces of the puck. Each plate has a set of three apertures aligned with the bores. The diameters of the apertures are less than the diameters of the bores and the bearings so that the plates hold the bearings in their respective bores, but allow the bearings to extend partially beyond the faces of the plates to support the puck relative to the floor.

In operation, after the puck has been hit by a hockey stick, the bearings rotate freely and the puck encounters little resistance from the surface on which it is traveling As the puck moves, the bearings roll against the surface and carry and support the puck, whose bottom face is spaced from the surface by the bearings.

An alternate and preferred embodiment of the present invention is a high density rubberized puck having concave recesses for the ball bearings. Plates are excluded from this embodiment, as the recesses themselves are sized to retain the bearings.

An advantage of the present invention is a hockey puck that encounters little resistance from the surface on which it moves after it is hit by a hockey stick. Passes and shots on goal may thus be of longer distance, high speed, and great accuracy.

Another advantage of the present invention is a hockey puck that is as massive as an ice hockey puck while maintaining the disk-like shape, composition, texture, and resiliency of an ice hockey puck. Therefore all forms of hockey may be played with a puck that possesses substantially all of the structural and functional characteristics of an ice hockey puck.

BRIEF DESCRIPTION OF THE DRAWINGS

FIG. 1 is an isometric view of the invention;

FIG. 2 is a top view of the invention shown in FIG. 1;

FIG. 3 shows a cross-section of the invention along lines 3—3 of FIG. 2;

FIG. 4 is an end view of the invention shown in FIG. 1.

FIG. 5 shows a cross-section of an alternate embodiment of the invention.

DESCRIPTION OF THE PREFERRED EMBODIMENT

As shown in FIGS. 1 and 3, a hockey puck 10 has a high density disk 11 forming a set of three bores or receptacles 12, a set of ball bearings 13, and a pair of retaining plates or faces 14. The disk 11 is formed from a massive compound similar if not identical to that used for ice hockey pucks. If desired, puck 10 may be formed from an ice hockey puck.

As shown in FIGS. 1, 2, 3, and 4, the bores 12 are formed through disk 11 and each has an axis A substantially perpendicular to the plates 14 and substantially parallel to an axis B of the disk 10. As shown in FIG. 2, the bores 12 are formed symmetrically in the disk 11 about axis B and are placed equidistantly from one another and equidistantly between axis B and an outer edge 15 of tho disk 11. Bores 12 may be placed closer to edge 15 or closer to axis B, depending on a number of factors, including the diameters and mass of the balls 13, the mass of the disk 11, the diameters of the bores 12 themselves, and the surface with which puck 10 is to cooperate. If the disk 11 is formed from an ice hockey puck, the bores 12 may be created by a drilling operation.

The ball bearings 13 have diameters slightly smaller than the diameters of the bores 12 so that the bearings 13 are freely rotatable in the bores 12 with a minimum of transverse movement between edges 12.1. The bearings 13 are of sufficient diameter to extend partially beyond the plates 14. The bearings 13 may be of sufficient mass so that the total mass of the puck 10, including the disk 11 and the plates 14, is substantially equal to that of a regulation ice hockey puck.

As shown in FIG. 3, each retaining plate 14 is connected to an opposing planar end 16 of disk 11, such as by gluing, and has a set of apertures 17. The apertures 17 are defined by a set of edges 19 of plates 14 and are aligned with the bores 12 about common axes A. The apertures 17 have smaller diameters than the diameters of bores 12 so that a set of lip portions 18 of the plate 14 overlap the bores 12. The lips 18 extend inwardly sufficiently to securely yet freely retain bearings 13 in their respective bores 13. The plates 14 and hence the disk 11 may be supported by edges 19 resting on the ball bearings 13.

Each plate 14 includes at its circumference a rounded edge 20 which lies flush with edge 15 of disk 11. Rounded edges 20 conform substantially to the shape of similar edges on a regulation ice hockey puck. After the plates 14 have been connected to opposing faces 16, the height of the puck 10, excluding the bearings 13, is preferably substantially equal to the height of a regulation ice hockey puck. If the puck 10 is to be formed from an ice hockey puck, opposing faces of a puck equal to the height of the plates 14 may be shaved or sawed from the ice hockey puck to form the opposing planar faces 16. Bearings 13 may then be placed in the bores 12 before the plates 14 are connected to the faces 16 to retain the bearings 13 in their respective bores 12.

In operation, after the puck 10 has been hit by a hockey stick, the ball bearings 13 support the puck 10 and freely revolve or rotate in their receptacles 12 so that the puck 10 may be hit in any direction with little resistance from a fixed surface. The puck 10 moves with either plate 14 adjacent the fixed surface. Moreover, the free revolutions of the ball bearings 13 allow the puck 10 to spin about axis B. Hence, the puck 10 functions on a street or gymnasium floor substantially like a regulation ice hockey puck behaves on ice.

In an alternate and preferred embodiment of the invention, as shown in FIG. 5, the puck 21 has a set of inwardly extending and integrally connected concave retainers 22 forming a set of receptacles 23 for the bearings 13. The receptacles 23 are defined by edges 23.1 of the retainers 22. The retainers 22 retain the bearings 13 securely yet rotatably in their respective receptacles 23. The outer ends 24 of the retainers 22 form apertures 25 having diameters less than the diameters of the bearings 13 but allow the bearings 13 to extend partially therethrough. The edges 23.1 of the integral retainers 22 are spaced from tee bearings 13 retained therein so that the bearings 13 are rotatable with a minimum amount of transverse movement.

The puck 21 may be fabricated in part by connecting, such as by gluing , a first half-section 26 of the puck 21 t o a second half-section 27 along a medial line 28 after inserting the bearings 13 in their respective receptacles 23. Half-sections 26 and 27 are similar in structure. Puck 21 includes a pair of outer faces 29 and an outer edge 30.

Alternatively, puck 21 may be fabricated in a molding process whereby the body of puck 21 is molded in a first molding step, and the bearings 13 are molded in a second and subsequent molding step. In this case the molding process and/or the relative choice of materials, are selected so as to create a finished product having freely-rotatable bearings seated and contained within a molded body. The state of the art in molding processes permits such a multiple-step mold operation to be accomplished wherein the bearings are indeed freely rotatable and seated within the body of the hockey puck.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. A hockey puck, for use on a playing surface, comprising:
   (a) a disk having a set of receptacles formed therein and, a pair of outer faces through which the receptacles open; and
   (b) a set of bearings, each bearing freely rotatably mounted in a receptacle, each bearing partially extending by a substantially equal distance from each said outer face, said bearings supporting either outer face of said disk relative to said playing surface.

2. The apparatus of claim 1, wherein each bearing further comprises a spherical ball, and each receptacle further comprises a seat for said spherical ball.

3. The apparatus as claimed in claim 2, wherein the number of said receptacles and said bearings comprises three.

4. The apparatus of claim 1, wherein said receptacles each further comprise a cylindrical bore through said disk and opening through said outer faces.

5. The apparatus as claimed in claim 4, further comprising a plate affixed to each of said outer faces, each of said plates having bores therethrough of diameters smaller than said receptacle bores.

6. The apparatus of claim 5, wherein said plates each have apertures formed therein and an outer edge, said apertures aligned with said receptacles so that said bearings extend partially through and are rotatable in said apertures, said apertures having diameters less than the diameters of said receptacles and said bearings.

7. The apparatus of claim 6, wherein said outer edge of said plate extends to and is flush with the outer edge of said disk.

* * * * *